US005356362A

United States Patent [19]

Becker et al.

[11] Patent Number: 5,356,362

[45] Date of Patent: Oct. 18, 1994

[54] APPARATUS FOR BODY EXERCISE, BODY STRETCHING, NEUROMUSCULAR AND OTHER ORTHOPEDIC MOVEMENTS

[75] Inventors: Richard B. Becker, Short Hills, N.J.; David D. Gilbert, New York, N.Y.

[73] Assignee: Yogi Pogi Inc., New York, N.Y.

[21] Appl. No.: 67,679

[22] Filed: May 26, 1993

[51] Int. Cl.[5] ..... A63B 21/00

[52] U.S. Cl. ..... 482/142; 482/907; 482/133

[58] Field of Search ..... 100/289, 290; 602/35, 602/32, 34, 39; 482/907, 133, 136, 134, 91, 92, 23, 38, 41

[56] References Cited

U.S. PATENT DOCUMENTS

| | | | |
|---|---|---|---|
| 283,463 | 8/1883 | Boomer | 100/290 |
| 974,240 | 11/1910 | Darr | 100/290 |
| 1,356,365 | 10/1920 | Hosmer | 602/32 |
| 2,525,204 | 10/1950 | Calabro | 100/290 |
| 3,109,646 | 11/1963 | Klein | 482/907 |
| 3,904,195 | 9/1975 | Chavanne | 482/133 |
| 5,026,049 | 6/1991 | Goodman | 482/907 |
| 5,092,585 | 3/1992 | Jones | 482/136 |
| 5,147,266 | 9/1992 | Ricard | 482/907 |
| 5,152,732 | 10/1992 | Sayre | 482/133 |

FOREIGN PATENT DOCUMENTS

| | | | |
|---|---|---|---|
| 0124745 | 11/1914 | Fed. Rep. of Germany | 602/39 |

*Primary Examiner*—Richard J. Apley
*Assistant Examiner*—Jerome Donnolly
*Attorney, Agent, or Firm*—Cooper & Dunham

[57] ABSTRACT

An exercise and stretching apparatus including a base, a pair of adjustable vertical uprights, and a cross-bar extending the uprights. The ends of the upper transverse bar are pronged and engage a movable retainer on each of the uprights. A handle and a rotatable bearing or releasable grip on each adjustable retainer helps raise or lower the cross-bar. The apparatus further includes a hinged, collapsible platform which may overlie or form part of the base.

20 Claims, 7 Drawing Sheets

APPARATUS FOR BODY EXERCISE, BODY STRETCHING, NEUROMUSCULAR AND OTHER ORTHOPEDIC MOVEMENTS

FIELD OF THE INVENTION

This application relates to an improved apparatus for exercise and body stretching to facilitate neuromuscular and other orthopedic movements for the purpose of rehabilitation or generally to gain and maintain flexibility and fitness, and more particularly to an apparatus having a stable base and a cross-bar, each side of which may be separately adjusted with minimal effort or assistance.

BACKGROUND OF THE INVENTION

Stretching devices for disabled users generally are known, but tend to be complicated, expensive and take up much room. In using such devices, the exerciser typically requires assistance from an attendant for proper use. For example, U.S. Pat. No. 3,904,195 (Chavanne) relates to a body exercising device having a vertical or horizontal surface to support the user's back and a pad opposing the surface and rotatable about a screw for pressing against the user's abdomen. The pad can be moved toward or away from the user by one of two handles provided on the screw. One handle is positioned for operation by an assistant, and the other handle is positioned for operation by the user.

Other more compact or collapsible exercise devices may be difficult to use by handicapped or disabled individuals. U.S. Pat. No. 3,109,646 (Klein), for example, shows a stretching device for ballet dancers. The device includes a cross-piece threaded at its center on a threaded pole. The threaded pole has a base at its bottom and a handle at its top. The dancer's feet are drawn close to the body and engage the base. The dancer's knees are spread apart and the cross-piece is positioned over the knees. The handle is rotated to displace the cross-piece vertically to press the knees downward. The device appears subject to toppling, and appears to require significant effort to turn the handle while maintaining balance. Some users may not have the strength or coordination to maintain the apparatus in proper position.

There is therefore a continuing need for a stretching and exercise apparatus which is structurally stable and relatively simple to use with minimal or no assistance.

SUMMARY OF THE INVENTION

It is accordingly an object of the present invention to overcome the drawbacks of known exercise devices by providing an exercise apparatus which is structurally stable, simple to use and simple to assemble and disassemble for storage or transport. The invention provides a stretching and exercise apparatus comprising a base having a pair of spaced, substantially parallel vertically extending threaded uprights. A cross-bar extends between the uprights when mounted in a transverse position with respect to the uprights. An adjustable retainer on each upright engages one end of the cross-bar. The adjustable retainers releasably grip the upright. The cross-bar may be lowered against the knees or lower thighs of the user thereby stretching the user's muscles and joints.

Other features, objects, and advantages of the invention will become apparent from the following detailed description of the invention taken in conjunction with the accompanying drawings.

DETAILED DESCRIPTION OF THE PREFERRED EMBODIMENTS

Figure 1:
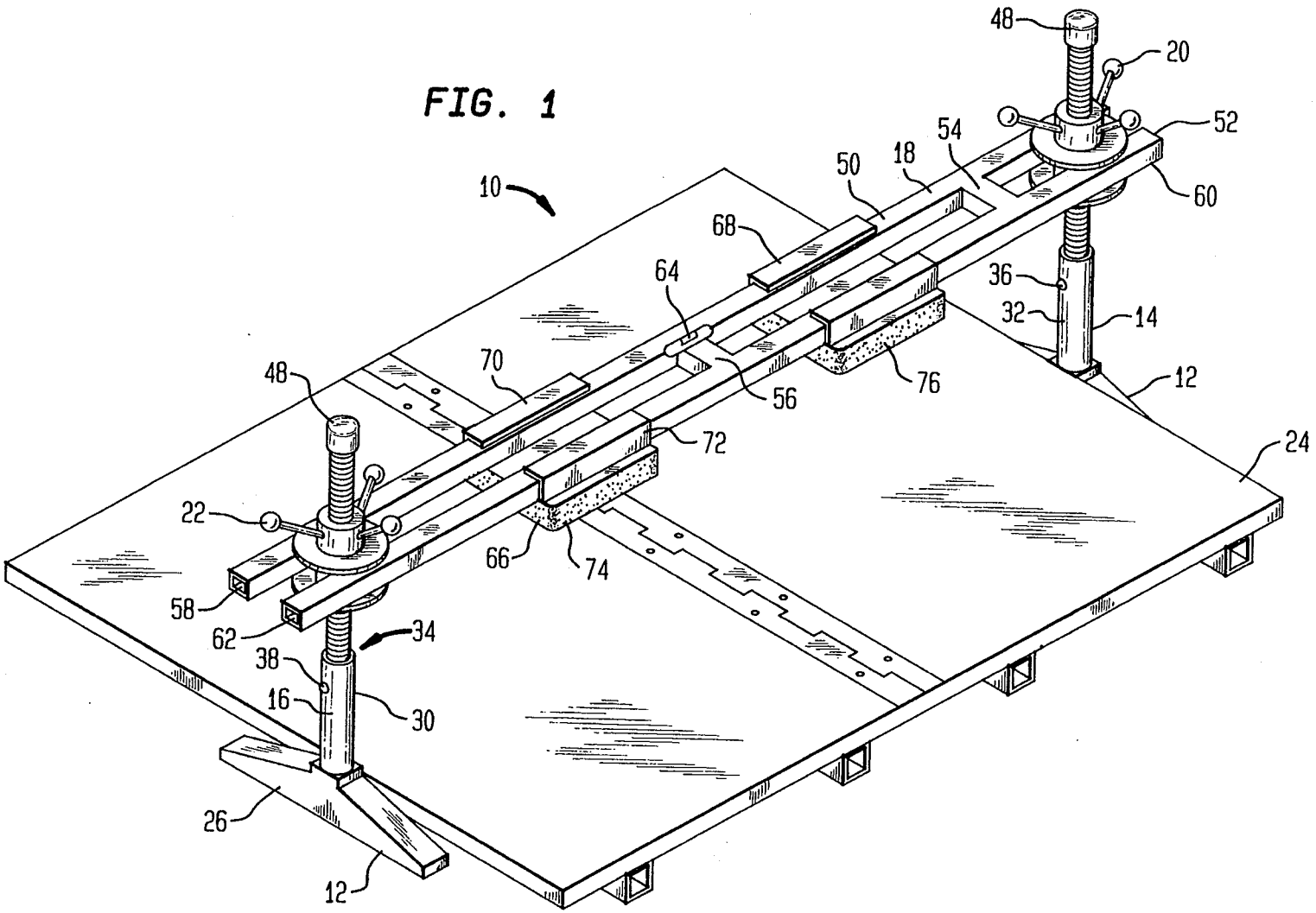
FIG. 1 is a perspective view of an exercise and stretching apparatus in accordance with the present invention.

Referring to the drawings, FIG. 1 illustrates a preferred embodiment of the exercise and stretching apparatus of the present invention, generally designated by the reference numeral 10. The apparatus 10 generally comprises a base 12 including first and second extendable uprights 14, 16 and a cross-bar 18 which spans or extends between the first and second uprights 14, 16. First and second adjustable retainers 20, 22 hold the cross-bar 18 in movable relationship with the uprights 14, 16. A platform 24 covers the base 12.

Figure 2:
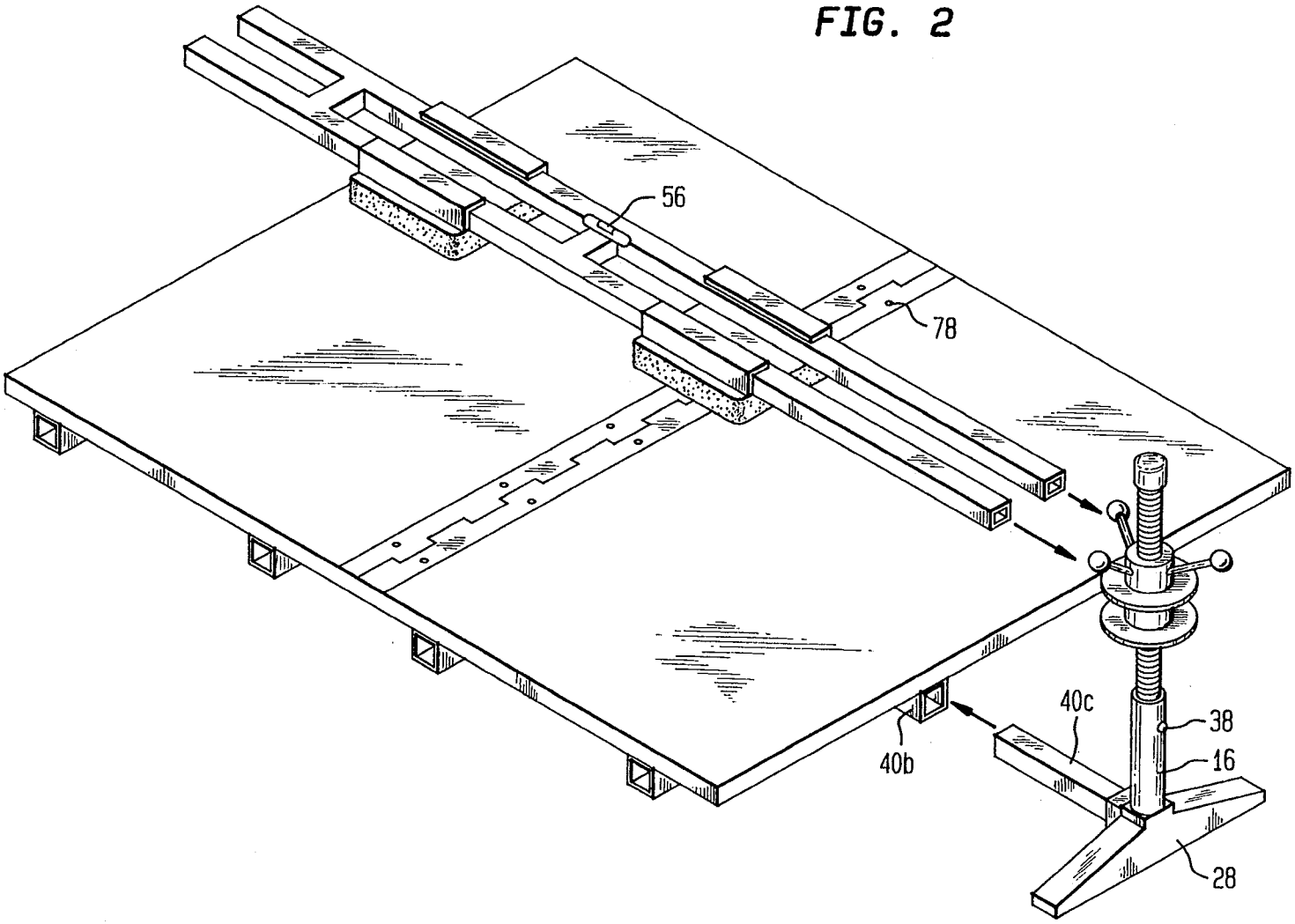
FIG. 2 is an exploded perspective view of the apparatus shown in FIG. 1.

The base 12, as shown in FIGS. 1 and 2, includes a pair of transversely extending legs 26, 28 to which are rigidly connected to sleeves 30, 32 by welding, soldering or other method of attaching metal to metal. As shown in FIG. 1, a representative leg 26 extends on both sides of the sleeve 30 to provide sufficient stability and balance to that side of the apparatus 10. The sleeves 30, 32 include openings 34, 36 drilled transversely therethrough to receive a pin 38. The legs 26, 28 are rigidly connected to one another by beam 40, which for convenience may disassemble into three nesting or otherwise interconnecting pieces 40*a,b,c*. Preferably, as shown in FIGS. 2–5, beam 40 may include three portions 40*a* which is mounted or connected to first upright 14, 40*b* which may be attached to the underside of platform 24 and may be hinged as shown in FIG. 4, and 40*c* which is attached to second upright 16.

Figure 3:
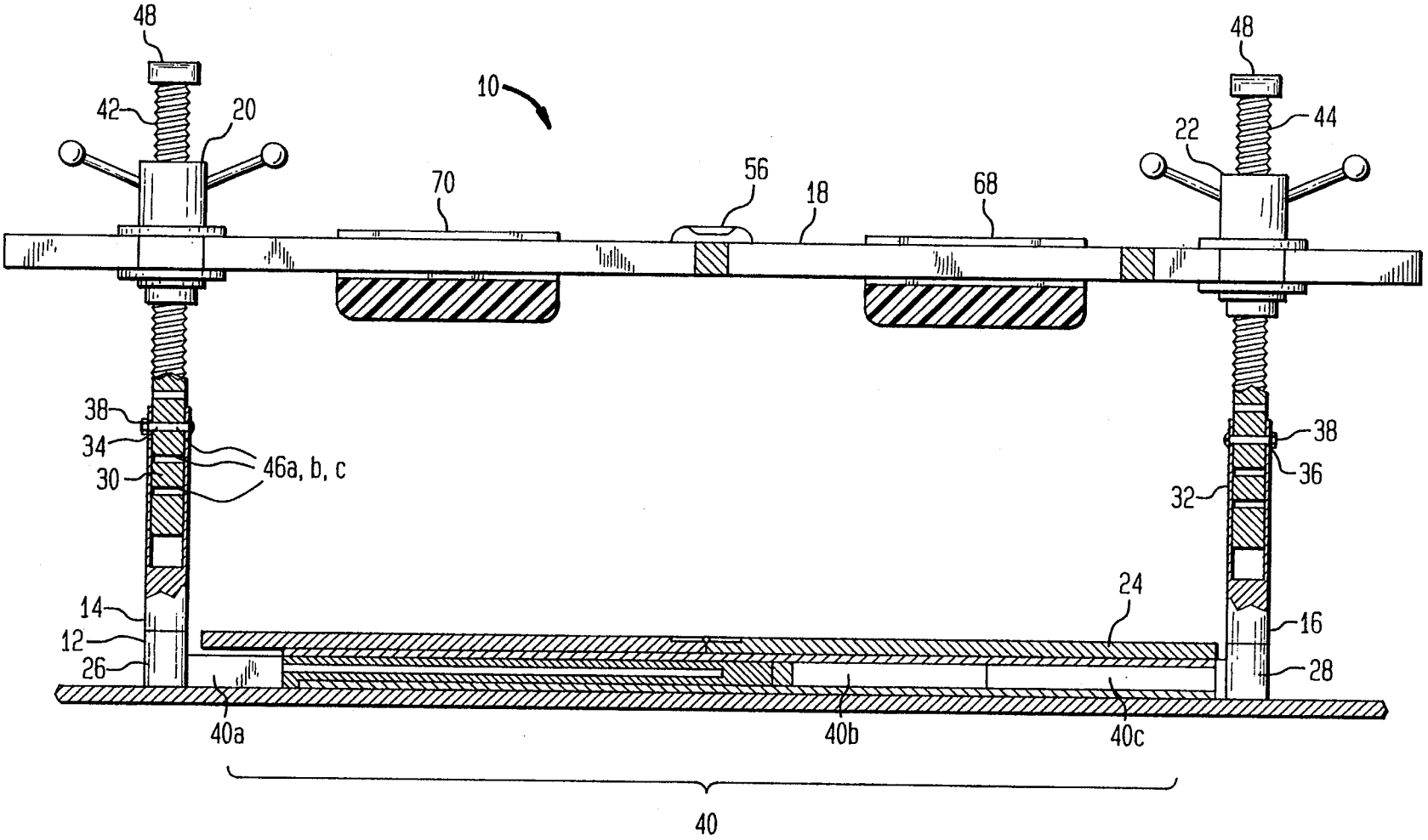
FIG. 3 is a front view partially in section of the apparatus shown in FIG. 1.

Referring to FIGS. 1–3, first and second extendable uprights 14, 16 have partially or fully threaded rods 42, 44 having a plurality of transverse openings 46*a,b,c* drilled therethrough to receive pin 38 for positioning and adjusting rods 42, 44 to a desired elevation. Each rod has a cap 48 to protect the user and the threading, and to prevent the adjustable retainers 20, 22 from inadvertently slipping off.

The cross-bar 18 includes two longitudinally extending members 50, 52 joined by two or more cross-pieces 54, 56. The cross-pieces 54, 56 are sized to join the longitudinally extending members 50, 52 such that they form a pair of prongs 60, 62 at respective ends of the cross-bar. Preferably the first cross-piece 54 is placed closer to one of the pronged ends 60, 62 than the second cross-piece 56. This allows the cross-bar 18 to be installed easily by sliding the end 62 having the longer prongs onto the respective adjustable retainer 22. The cross-bar 18 also includes a spirit level 64 and optional timer. A pair of slidable pads 66, 68 enable quick release or escape from the apparatus 10. As shown in FIGS. 1 and 2, the slidable pads 66, 68 have brackets 70, 72 to capture the longitudinal members 50, 52 to permit adjustment so that the foam pads 74, 76 may be aligned with the user's knee or lower thigh.

Figure 4:
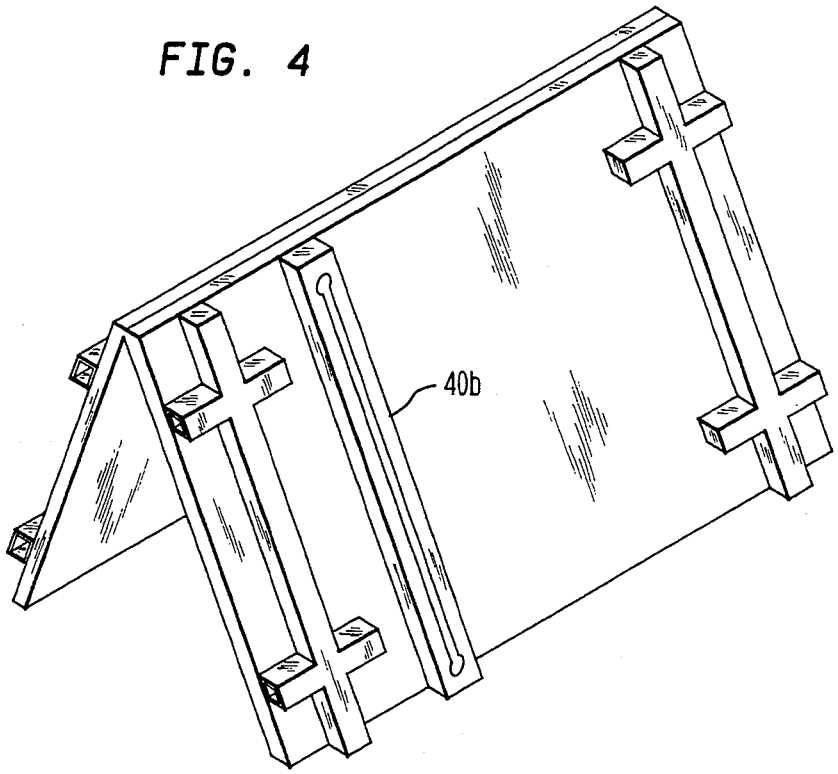
FIG. 4 is a perspective view of the folding platform for use in the embodiment shown in FIG. 1.
Figure 5:
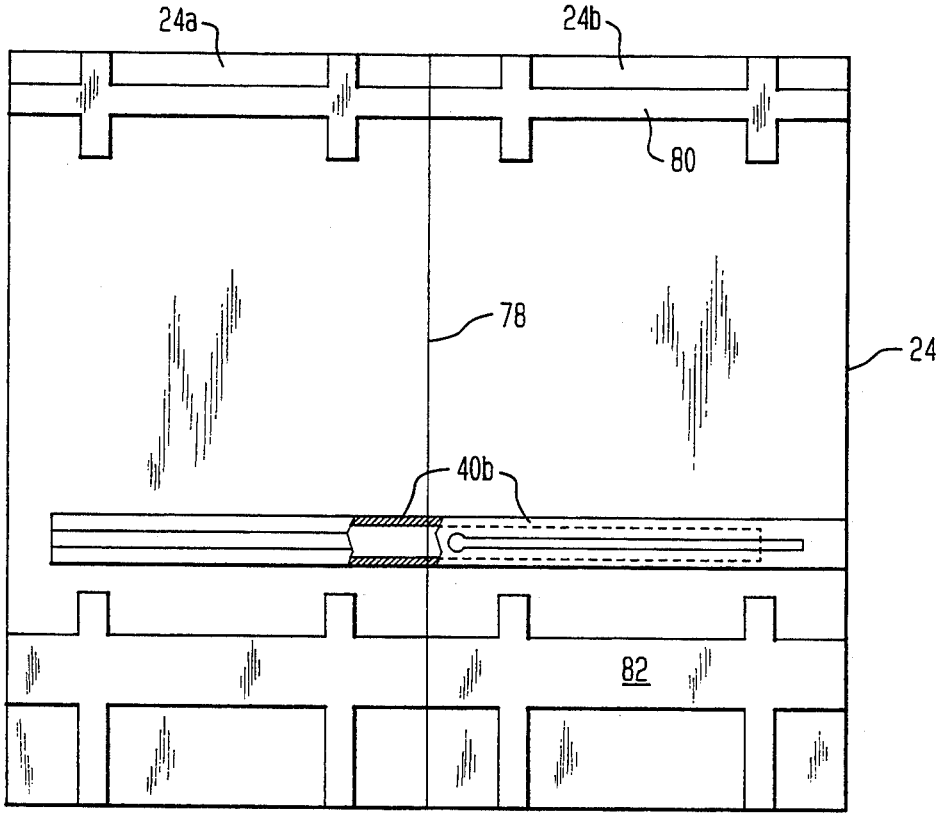
FIG. 5 is a bottom view of the folding platform shown in FIG. 4.

FIGS. 2, 4 and 5 help understand the structure of the platform 24. The platform 24 may be a pad which overlies the base 12 or more particularly beam 40, but preferably the platform 24 has the structure depicted in FIGS. 4 and 5. The platform 24 can fold into two or more portions to permit easy carrying and storage. In the case of a two-piece platform, half portions **24*a* and 24*b* are connected by piano hinge 78 bisecting the platform 24 (best shown in FIG. 2). Where the platform 24 connects with the base 12 the platform has affixed to the bottom a portion 40*b* of beam 40 and additional support members 80, 82, which are roughly the same thickness as beam 40, so that the platform provides a flat and supportive surface on which the user can sit or lie. Alternatively, beam portion 40*b* can be a rib (not shown) positioned to cooperate with support member 82 to capture beam 40 between the rib and the support member 82, thereby preventing slippage of the platform 24**.

Figure 7:
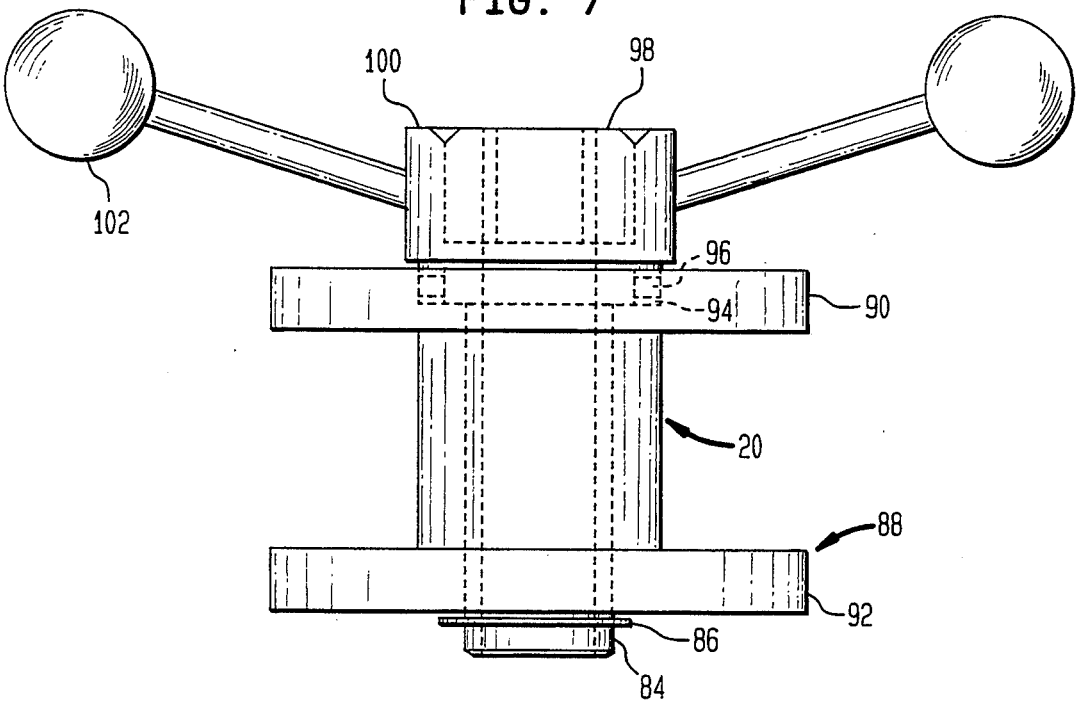
FIG. 7 is an enlarged sectional view of an adjustable retainer for use in the apparatus of FIG. 1.

The first and second retainers 20, 22 may be based on, for example, a screw mechanism, a rachet mechanism, or releasable slidable clamps. Referring now to FIGS. 1, 3 and 7, each of the first and second adjustable retainers 20, 22 has similar if not identical construction. As shown in FIG. 7, each of the retainers 20, 22 has a hollow (preferably unthreaded) cylindrical sleeve 84 at the bottom of which is fitted a bearing snap ring 86. A nylon spool 88 having a central bore therethrough fits onto the sleeve 84 and rests against snap ring 86. The spool 88 has shoulders 90, 92 which capture the pronged ends 60, 62 of the cross-pieces 54, 56. At the upper end of the spool 88 a cup 94 is cut or formed to receive a thrust bearing 96 (or other bearing) which lies underneath a threaded nut 98. The threaded nut 98 attaches to sleeve 84 and mates with the threading on rods 42, 44. The nut 98 is covered by a housing or cover 100 (held by friction) onto which are welded or otherwise attached three knobbed turning handles 102. The interior of the cylindrical sleeve 84 is sized to be slightly larger in diameter than the diameters of the first and second threaded rods 40, 42. This arrangement permits the spool 88 to move vertically without rotating when the height of cross-bar 18 gets adjusted. Alternatively, the entire adjustable retainer 20, 22 can be molded in one or two pieces of Delrin.

The cross-bar 18 may be of 1" square (cross-section) aluminum, about 48 inches long with cross-pieces 54, 56 arranged so that the longer slot measures approximately 21 inches with the smaller slot of 6" long. The uprights and the threaded rods may be made of aluminum, steel, or preferably Delrin.

The exercise and stretching apparatus 10 is assembled and used as follows, referring to FIGS. 1–5. The base 12 is assembled by positioning legs 26, 28 at a suitable distance apart with the sleeves 30, 32 standing upright. A partially or fully threaded rod 42, 44 is inserted into each sleeve 30, 32 and a pin 38 is inserted in each opening 34, 36 in the sleeve 32 and in one of the openings **46*a,b,c* in the rods 42, 44 to hold the rod 42, 44 at a predetermined elevation in the sleeve 30, 32. The legs 26, 28 are sized and weighted such that the base 12 is freestanding without beam 40 to ease assembly, but strengthens and rigidifies considerably when interconnecting portions of the beam 40*a,b,c* are connected to link the first and second uprights 14, 16**.

In the embodiment shown in FIGS. 1–5 where a portion of the beam **40*b* is attached to the platform 24, the platform 24 is placed in folded position to align beam portion 40*b* with ends of beam portions 40*a* and 40*c*. The beam portions 40*a,b,c* slide or otherwise connect into one another, thus completing assembly of the base 12. Adjustable retainers 20, 22 are placed on each extendable threaded rod 42, 44 and adjusted so that the retainers 20, 22 are approximately the same height from the floor or other surface (not shown). The platform 24 is unfolded, then cross-bar 18 is installed onto the retainers 20, 22 by inserting long slot 63 onto spool 88 with the cross-bar 18 at an angle to a horizontal plane. The bar 18 is slid around spool 88 further than its ultimate intended position, and then is turned about a horizontal axis until the cross-bar is parallel to the platform 24. The cross-bar 18 is then slid in an opposite direction toward second retainer 22 so that the pronged end 62 engages spool 88 of the second retainer 22. Cross-pieces 54, 56 limit the horizontal displacement of cross-bar 18 so that both ends of cross-bar 18 securely engage the retainers 20, 22**.

Finally, slidable pads 66, 68 are moved into approximate position to rest above the knees of the user when sitting on the platform 24. The cross-bar may be adjusted by reference to level 64.

Figure 6:
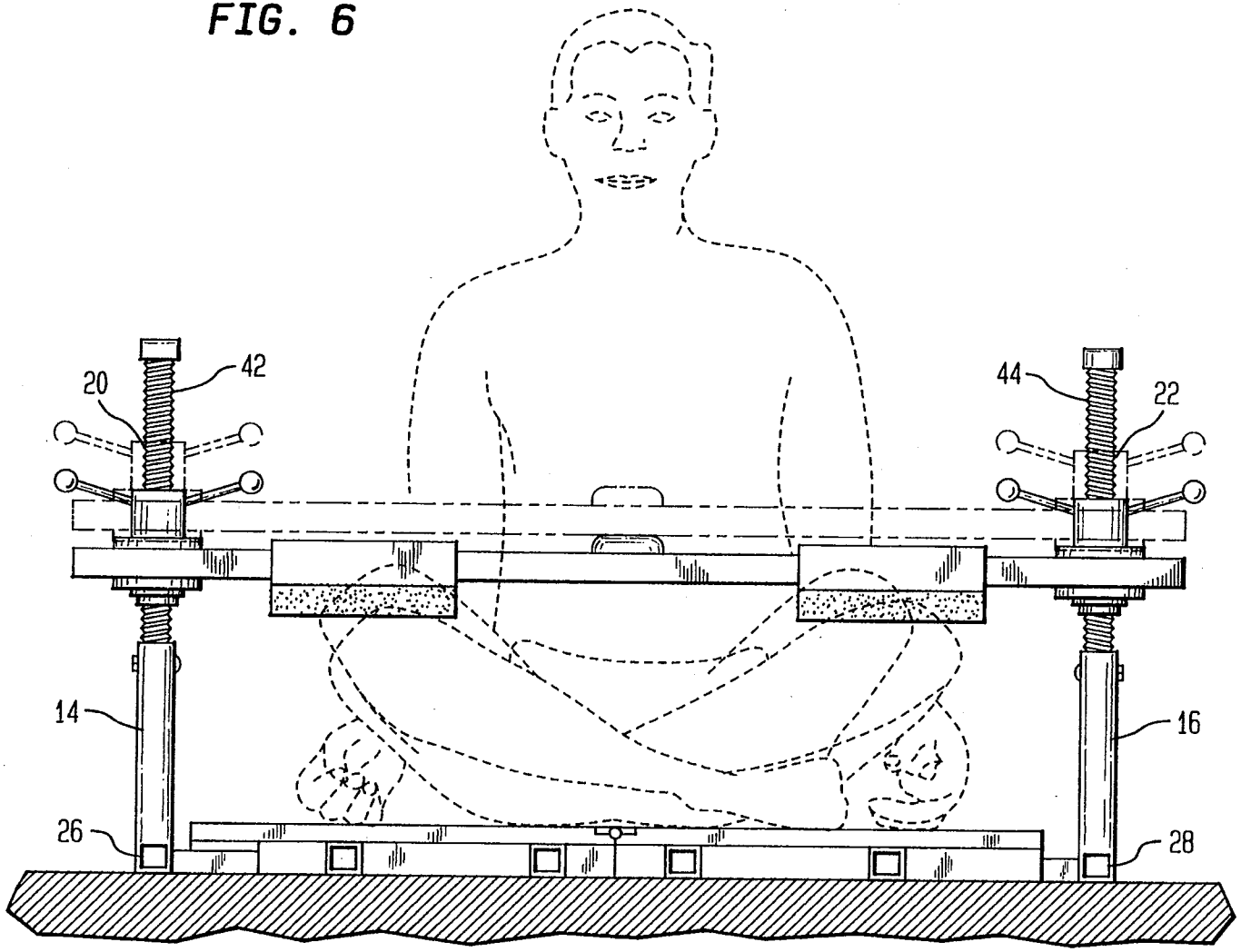
FIG. 6 is a front view of an embodiment of the present invention in use.

As illustrated in FIGS. 6 and 7, the user sits cross-legged on platform 24 facing the cross-bar 18 with his body on one side of the cross-bar 18 and his knees on the other side. The user rotates each handle 102, 104 to move adjustable retainers 20, 22 downwardly along rods 42, 44 until they begin to press firmly on a portion of each of the user's legs.

The retainers 20, 22 may be rotated simultaneously or sequentially, depending on the ability and preference of the user. To facilitate sequential operation of each connector 20, 22, the thickness of spool 88 is slightly larger than the thickness of cross-bar 18, thereby allowing a limited range of vertical displacement of one end 60 of the cross-bar 18 relative to the other end 62 without jamming. This feature allows for asymmetric settings where, for example, one of the user's legs is more flexible than the other. Level 64 helps indicate to the user when cross-bar 18 is level or tilted in one direction or the other. When the user's legs become accustomed to the new position either after a few moments or after one or more sessions, the cross-bar 18 can be lowered further in the same manner. The cross-bar 18 serves to apply pressure to the user's legs while simultaneously supporting the user in the stretch position.

FIG. 7 illustrates the manner in which the user can enhance the benefits of the present invention by leaning backwards to stretch the lower back in addition to hip and leg muscles. Further, since the lower body of the user is stabilized between the seat and upper cross-bar 18, the user can include arm movements to facilitate stretching of the back and shoulders or can stretch one leg at a time.

Figure 8:
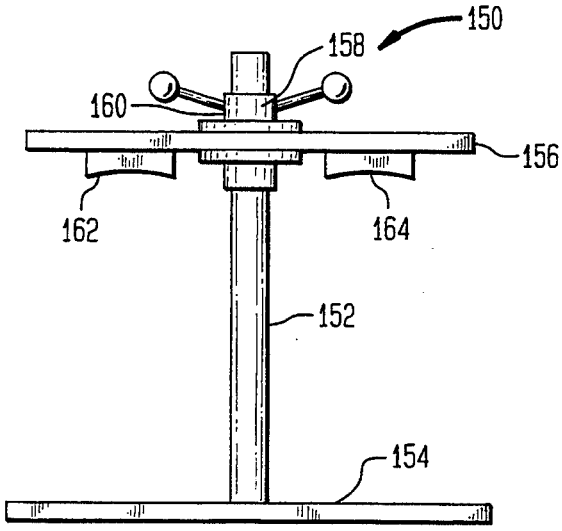
FIG. 8 is an elevational view of a second preferred embodiment in accordance with the present invention.

FIG. 8 depicts another embodiment of the apparatus 150 using a single upright 152 on a base 154 with a cross-bar 156 held by an adjustable retainer 158 including a bearing 160 having at least one handle. The cross-bar 156 has adjustable kneepads 162, 164.

It should now be apparent to a person of ordinary skill that the present invention provides great flexibility in the type of stretches and exercises which can be performed while using the device. For example, torso stretches can be performed by lifting the arms overhead and swaying from side to side while the legs of the user are anchored in the apparatus 10. This stretch may be accomplished because the lower portion of the user's body is held during the exercise. The elongated base 12 distributes the weight of the user and provides added balance to both the device and the exerciser during use. The apparatus 10 also permits a user to stretch one leg without engaging the other. This may be of particular importance for physical therapy, for example, where a patient needs to rehabilitate one leg only. Further, the apparatus 10 permits addition of add-on features such as an overhead pulley system (not shown) to aid in torso stretching.

Figure 9:
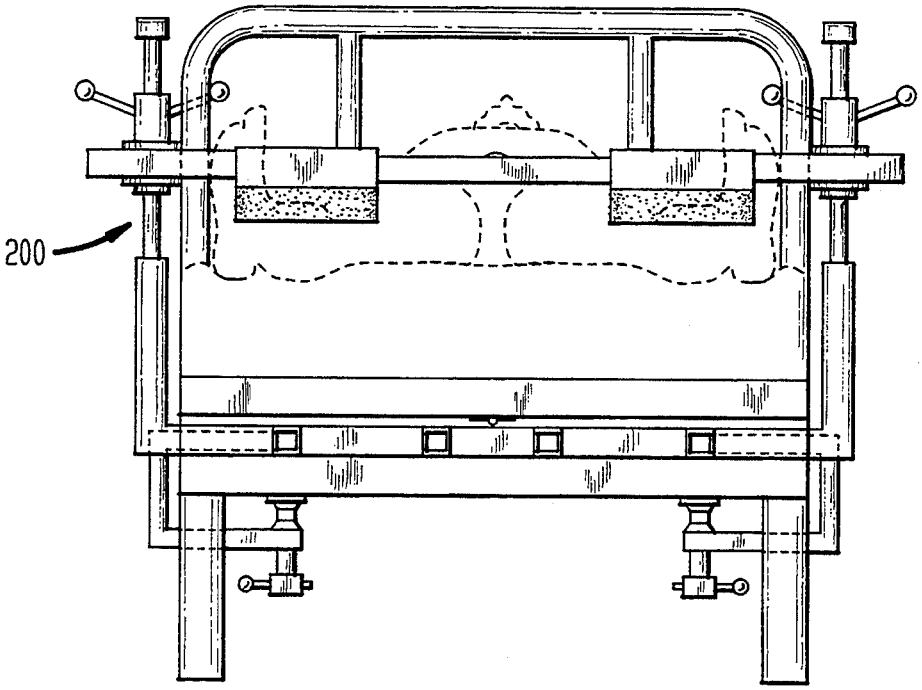
FIG. 9 is an elevational view of another preferred embodiment of the apparatus of FIG. 1 shown in combination with a hospital bed.

Further, the apparatus permits use by patients with only minimal hand strength. The retainers 20, 22 containing thrust bearings 96 permit application of pressure to lower the cross-bar 18 with minimal effort. Another embodiment of the device is shown in FIG. 9 in which the apparatus 200 is shown with the device 10 clamped on a hospital bed. The device may be used for rehabilitating and stretching the legs of bedridden patients such as those who have recently undergone hip replacement surgery. In such an embodiment, the platform 24 is unnecessary, and wheels or glides may be provided to the base 12 to facilitate movement of the apparatus 200 adjacent and away from the hospital bed.

The present invention thus provides a stretching apparatus that is structurally stable and simple for the disabled and handicapped to use without assistance. The present invention additionally is effective for use by fit individuals, such as practitioners of yoga, martial arts, and dancers. The invention provides a structurally stable mechanism, yet can easily be disassembled for storage and transport.

It should be understood that preferred embodiments of an exercise and stretching apparatus have been described, and that many alterations, modifications, and changes in the invention may occur to persons of ordinary skill. For example, the adjustable retainers may be made of rachets which cooperate with grooves or holes in the upright. It is therefore intended that the scope of the invention be governed by the following claims, including all equivalents.

What is claimed is:

1. An exercise and stretching apparatus, comprising:

a base having a pair of spaced vertical uprights;

a cross-bar extending between the uprights above the base;

the cross-bar, having means for engaging legs of a user;

first and second retainers movably on the first and second uprights to engage one end of the cross-bar to an upright;

first and second releasable means associated with one of the first and second retainers to vertically displace the first and second retainers thereby vertically displacing the cross-bar such that when a user sits beneath the cross-bar, the first and second retainers can be adjusted downwardly along the pair of uprights to press firmly on a portion of the legs of the user.

2. An apparatus in accordance with claim 1 wherein each of the first and second retainers includes a spool.

3. An apparatus in accordance with claim 1 wherein each of the first and second releasable means has a collar including a threaded portion and a bearing portion attached to the spool, and wherein the threaded bearing cooperates with threading on the first and second uprights.

4. An apparatus in accordance with claim 1, wherein each of the first and second releasable means clamps to the first and second uprights.

5. An exercise and stretching apparatus comprising:

a base having a pair of spaced, substantially parallel, vertically extending uprights having a threaded upper portion;

first adjustable retainer having a spool including a central bore therethrough sized to slide on one of the uprights, a threaded portion matable with the threaded upper portion on said uprights, and rotatable gripping means for moving the adjustable retainer vertically with respect to the uprights;

second adjustable retainer having a spool including a central bore therethrough sized to slide on one of the uprights, a threaded portion matable with the threaded upper portion on said uprights, and rotatable gripping means for moving the adjustable retainer vertically with respect to the uprights; and a cross-bar having first and second pronged ends for engaging the first and second adjustable retainers and including means for engaging legs of a user, such that rotating the first and second retainers raises or lowers the cross-bar such that when a user sits beneath the cross-bar, the first and second retainers can be adjusted downwardly along the pair of uprights to press firmly on a portion of the legs of the user.

6. An apparatus according to claim 5, wherein the cross-bar comprises a pair of legs and at least two cross-pieces for connecting the legs together, the legs and the cross-bars defining open ended slots, one slot having a length substantially longer than the other slot.

7. An apparatus according to claim 6, wherein the rotatable gripping means includes at least one handle and a bearing to facilitate movement of the first and second adjustable retainers.

8. An apparatus according to claim 5, further comprising a platform removably connected to or included in the base.

9. An apparatus according to claim 8, further comprising support means arranged on a lower surface to level said platform.

10. An apparatus according to claim 5, wherein the ends of the base are connected by an intermediate beam.

11. An apparatus according to claim 5, wherein each upright comprises a sleeve and a threaded rod removably extending therefrom.

12. An exercise and stretching apparatus, comprising:

a longitudinally extending base having a pair of substantially parallel vertically upright sleeves extending therefrom;

a rod having a threaded portion extendably captured in each of said upright sleeves;

first and second spools, each having a threaded portion, an unthreaded portion and a bearing portion, said threaded portion engaging one of the threaded rods extending from each of the vertically extending upright sleeves, said bearing portion including at least one handle for gripping and turning the first and second retaining spools to raise or lower the spools with respect to threaded rods and a thrust bearing to facilitate turning the spools a cross-bar having first and second pronged ends for engaging the first and second adjustable retainers and including a pair of pads for engaging a user's legs, such that rotating the first and second retainers raises or lowers the cross-bar such that when the user sits beneath the cross-bar, the first and second spools can be adjusted downwardly along the pair of uprights to press firmly on a portion of the legs of the user.

13. An apparatus according to claim 12, further comprising a pair of slidable knee pads connected to the cross-bar.

14. An apparatus according to claim 12, further comprising a platform connected to or included in the base.

15. An apparatus according to claim 13, further comprising support means arranged on a lower surface of the platform.

16. An apparatus according to claim 15, wherein the ends of said base are joined by an intermediate beam.

17. An apparatus for exercising and stretching, comprising:

a base having a transverse member and first and second vertically extending, substantially parallel upright sleeves extending therefrom;

first and second threaded rods captured in and extending above the first and second sleeves;

a cross-bar comprising a pair of hollow tubes rigidly linked by a pair of spaced cross-members, the hollow tubes and the cross-members cooperating to define longitudinally extending first and second slots at each end of the cross-bar and having a pair of slidable pads mounted thereon; and first and second adjustable retaining spools, each having a threaded portion, a bore extending therethrough, upper and lower shoulders to capture a tint or second slot of the padded cross-bar, and a thrust bearing having a plurality of arms attached thereto for rotating the retainers in an upward or downward direction such that when a user sits beneath the cross-bar, the first and second retainers can be adjusted downward along the pair of uprights to press firmly on a portion of the legs of the user.

18. An apparatus in accordance with claim 17 additionally comprising a mat or platform positioned between the uprights.

19. An apparatus in accordance with claim 18 wherein each of said retainers may be separately adjusted.

20. An apparatus in accordance with claim 18 wherein the cross-bar further includes a pair of movable pads.

* * * * *